United States Patent [19]

Lurie

[11] Patent Number: 4,921,597

[45] Date of Patent: May 1, 1990

[54] MAGNETIC SEPARATORS

[75] Inventor: Walter Lurie, Pittsburgh, Pa.

[73] Assignee: CLI International Enterprises, Inc., Pittsburgh, Pa.

[21] Appl. No.: 405,039

[22] Filed: Sep. 8, 1989

Related U.S. Application Data

[63] Continuation of Ser. No. 219,722, Jul. 15, 1988, abandoned.

[51] Int. Cl.[5] ..... B03C 1/14; B03C 1/30

[52] U.S. Cl. ..... 209/223.2; 209/39; 209/232

[58] Field of Search ..... 209/223.1, 223.2, 232, 209/231, 39, 40

[56] References Cited

U.S. PATENT DOCUMENTS

| | | | |
|---|---|---|---|
| 946,394 | 1/1910 | Ohrn | 209/223.2 |
| 2,564,515 | 8/1951 | Vogel | 209/39 X |
| 2,607,478 | 8/1952 | Newton | 209/223.2 |
| 2,675,918 | 4/1954 | Newton | 209/232 |
| 2,952,361 | 9/1960 | Newton | 209/223.1 |
| 3,168,464 | 2/1965 | Ferris et al. | 209/223.1 |

FOREIGN PATENT DOCUMENTS

| | | | |
|---|---|---|---|
| 320304 | 11/1971 | U.S.S.R. | 209/223.2 |
| 446311 | 10/1974 | U.S.S.R. | 209/223.2 |

*Primary Examiner*—Donald T. Hajec
*Attorney, Agent, or Firm*—Walter J. Blenko, Jr.

[57] ABSTRACT

A magnetic separator to separate fine particles or ferrosilicon of magnetite from water. A drum is provided which rotates counter to flow of water past the drum. Magnets are provided within the drum to attract magnetite or ferrosilicon in the water to the drum.

5 Claims, 1 Drawing Sheet

MAGNETIC SEPARATORS

This is a continuation of Ser. No. 219,722, filed July 15, 1988, now abandoned.

This invention relates to magnetic separators for removing magnetic particles from slurries. More particularly, the invention relates to rotary drum magnetic separators in which magnetic particles are attracted to the drum and removed from the slurry by rotation of the drum.

BACKGROUND OF THE INVENTION

The use of heavy media separation is well known in mineral preparation and the like, e.g., coal preparation. The process comprises introducing finely divided particles of high magnetic susceptibility (EG magnetite or ferrosilicon) into water to form a slurry, adjusting the amount of magnetite or ferrosilicon so that the slurry has a desired specific gravity and then introducing the mineral into the slurry. A separation is achieved between those mineral particles which have a specific gravity less than the specific gravity of the slurry and which float across, and those mineral particles which have a higher specific gravity than the slurry and which sink. If the mineral is coal, the magnetite slurry may be adjusted to have a specific gravity in the range of 1.35 to 1.50, for example. Pieces which have a specific gravity of less than 1.35 will float and may be assumed to be high quality coal without greatly reduced ash or sulfur content. Pieces which sink at a specific gravity of 1.50 may be considered to be predominantly refuse. Pieces between 1.35 and 1.50 specific gravity may be considered to be of intermediate quality.

The cost of magnetite for heavy media separation is significant and it is desirable to recover the magnetite to the greatest possible extent. It has been found that the presence of magnetite particles smaller than 5 microns is especially helpful in providing a stable process which leads to an increased yield. Improved recoveries of clean coal, for example, may be expected to be in the range of 2 to 5% if the slurry includes a certain minimum proportion of −5 micron particles.

In the operation of a heavy media separation plant separating coal, the float coal and sink coal from the heavy media vessels carry significant quantities of magnetite from the vessels by surface adhesion. The coal is passed over screens where it is washed to remove the magnetite, and it is then moved to storage silos or the like. The magnetite and wash water are passed through magnetic separators where the magnetite is removed to the greatest extent possible and is returned to the heavy media vessel. The use of magnetic separators is well known and numerous designs have been tried.

SUMMARY OF THE INVENTION

I provide a wet drum counterrotation magnetic separator comprising a tank for retention of the slurry, a rotatable drum positioned in the tank with a segment of the drum positioned beneath the surface of the slurry, a lower arc of the circular wall of the drum in close proximity to the bottom of the tank, magnet means positioned within the drum and extending around a second lower arc of the circular wall of the drum, and a slurry settling zone in proximity to the ciruclar wall of the drum. I furthur provide magnet means in juxtaposition to the circular wall of the drum in the slurry settling zone. I provide slurry discharge means from the slurry settling zone. I prefer to provide a slurry overflow weir, and a slurry underflow outlet. I further provide a magnetite discharge from the magnetic separator.

Other details, objects, and advantages of my invention will become more apparent as the following description of a present preferred embodiment thereof proceeds.

DETAILED DESCRIPTION

Figure 1:
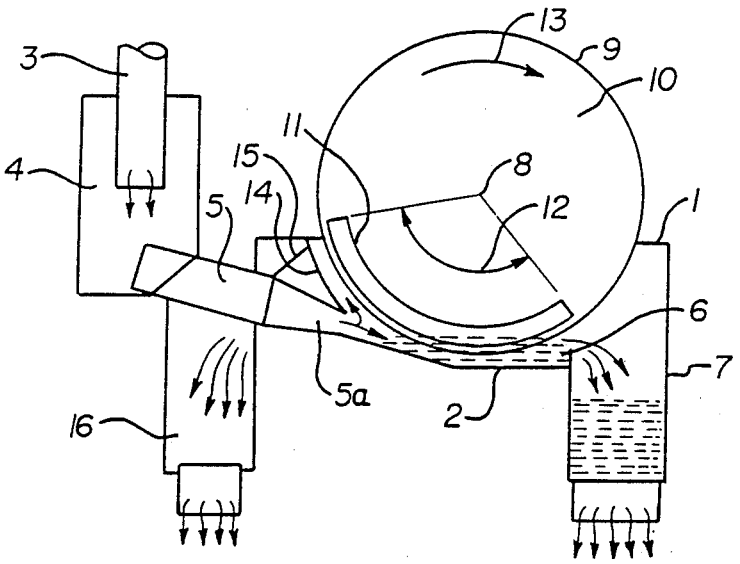
FIG. 1 PRIOR ART
FIG. 1 shows a diagrammatic view of a wet drum counter-rotation magnetic separator of conventional design.
Figure 2:
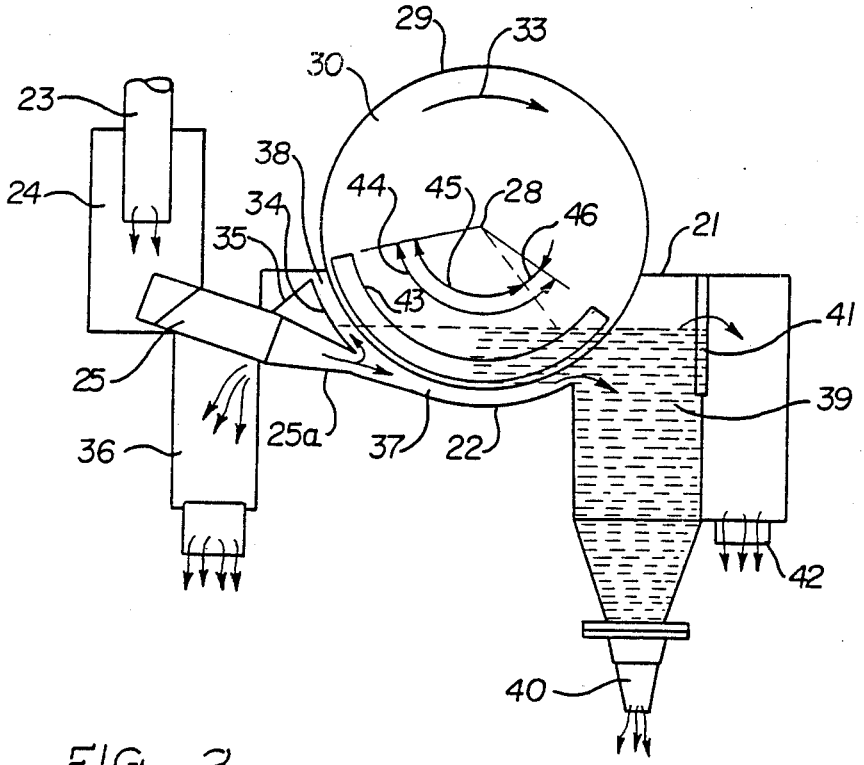
FIG. 2 shows a wet drum counter-rotation magnetic separator embodying my invention.

FIG. 1 shows an end view of a conventional magnetic separator with some parts cut away for clarity of illustration The separator comprises a slurry tank 1 having a bottom 2. A slurry feed pipe 3 delivers slurry to a manifold 4. The slurry consists of magnetite particles washed from coal after separation and the wash water. An injection nozzle 5 is connected to manifold 4 and discharges through a restricted opening **5*a* along the bottom 2 of tank 1. Customarily, a plurality of nozzles are placed along one side of the tank. On the opposite side of tank bottom 2 from injection nozzle 5, a weir 6 is provided extending along the side of the tank. On the opposite side of weir 6 from tank bottom 2, a tail race 7 extends downwardly. A drum is mounted within tank 1 on a horizontal axis 8. The drum comprises an outer circular wall 9 and an end wall 10. It will be understood by those familiar with the art that a second end wall is provided at the opposite end of the drum. A plurality of magnets, shown in outline 11, are positioned around a bottom arc of the drum within the drum and in juxtaposition to the circular wall. The magnets extend around an arc 12. The drum is driven by a motor in a conventional manner in the direction shown by arrow 13. A guide 14 is in close proximity to the lower circular wall of the drum above injection nozzles 5. A guard 15 extends from the upper end of guide 14 to a magnetite discharge chute 16**.

In operation of the separator shown in FIG. 1, slurry is delivered through feed pipe 3 to manifold 4. The slurry is distributed by the manifold to injection nozzles 5 which inject the slurry into the confined space between the bottom circular wall of the drum and tank bottom 2. Weir 6 causes the slurry to rise to the level of the weir so that the bottom portion of the drum rotates through the slurry. As slurry is introduced into the tank through nozzles 5, the drum is rotated as shown by arrow 13 so that the surface of the drum is traveling in the opposite direction to slurry passing through a restricted passage between tank bottom 2 and the lower arc of drum circular wall 9. The permanent magnets attract the magnetite particles to the surface of the drum. As the drum revolves, the magnetite particles are carried up the restricted space between guide 14 and circular wall 9 while the liquid passes over weir 6. As the magnetite cake reaches the top of guide 14, the effect of magnets 11 is reduced and the magnetite falls over guard 15 to magnetite discharge chute 16. The wash water from which magnetite has been removed by magnetic separation passes from the tank through tail race 7.

The separator of the present invention comprises a slurry tank 21 having a bottom 22. A slurry feed pipe 23 delivers a slurry consisting of wash water and magnetite to a manifold 24. An injection nozzle 25 leads from manifold 24 to tank 21 and has a restricted opening 25*a* through which the feed slurry is injected into the tank. It will be understood by those skilled in the art that a series of injection nozzles 25 are provided from manifold 24 with the injection nozzles being spaced at intervals along one side of the tank 21. A drum is positioned on a horizontal axis 28. The drum includes an outer circular wall 29 and an end wall 30. A similar wall is provided at each end of the drum. The drum is driven in conventional fashion by a motor in the direction shown by arrow 33. A restricted zone 37 is formed between tank bottom wall 22 and the lower arc of drum circular wall 29. A magnetite guide 34 extends upwardly above nozzles 25 following the curvature of drum circular wall 29. A restricted zone 38 is formed between guide 34 and drum circular wall 29. A magnetite guard 35 extends from the upper edge of guide 34 to a magnetite discharge chute 36.

The side of tank 21 opposite to injection nozzles 25 has a settling zone 39 which is of large cross sectional area compared to restricted zone 37. An underflow outlet 40 is provided at the bottom of settling zone 39, and an overflow weir 41 is provided at one side of settling zone 39. Liquid which passes over weir 41 discharges through an overflow 42.

Permanent magnets (generally of ceramic material) are positioned within the drum in juxtaposition to outer circular wall 29 around a lower arc of the circular wall. The position of the magnets is shown in outline 43. The magnets extend around an arc 44 which is greater than the arc of the magnets in a conventional drum separator. For purposes of comparison, the arc of the magnets in a conventional separator is shown at 45 and the additional arc of the separate magnets in the separator of the invention is shown at 46.

In operation of the apparatus, slurry is introduced through feed pipe 23, manifold 24, and injection nozzles 25. The slurry issues through restrictions 25*a* at high velocity and continues to move at a high velocity through the restricted zone 37. Magnetite which is in the slurry is attracted to the drum by magnets 43. Because of the high velocity, some of the magnetite particles, especially −5 micron particles, will be carried by the moving stream through the entire length of restricted zone 37. When the slurry reaches settling zone 39, the velocity is reduced giving magnets 43 an additional opportunity to attract magnetite particles, especially −5 micron particles, to the outer surface of circular wall 29. As the drum revolves, magnetite particles attracted to the drum wall are held to the drum wall by the magnets. The particles are carried in a direction opposite to the flow of the slurry through restricted zone 37 into restricted zone 38 in the form of a cake on the drum wall. As the drum revolves further and the magnetite particles pass beyond the influence of magnets 43, the particles will fall onto guard 35 which diverts the magnetite to chute 36. The particles are then returned to the heavy media vessel to maintain the desired specific gravity of the slurry in the vessel.

The overflow from the settling zone over weir 41 has a low content of magnetic material consisting only of very fine particles. Other heavier particles which escape the influence of the magnets within the drum settle out and are discharged through underflow outlet 40. The overflow outlet is sufficiently clarified that it is suitable for use as wash water for coal pieces which are being washed free of magnetite after leaving the heavy media vessel.

The separator of the present invention will reduce the magnetite content of the tailings to about 0.10 to 0.20 grams per liter which is considered to be one-third to one-fifth the amount of magnetite in the tailings from a conventional separator operating under a like type of duty. Moreover, the separator of the invention is able to tolerate higher concentrations of magnetite in the feed slurry without choking which results in heavy losses of magnetite. Because of the high cost of magnetite and the efficiency of the separator of the present invention, annual savings in magnetite of $50,000 to $250,000 may be anticipated in a large heavy media separation plan having a capacity in the order of 1,000 tons per hour.

While I have illustrated and described a present preferred embodiment of my invention, it is to be understood that I do not limit myself thereto by my invention may be otherwise variously practiced within the scope of the following claims.

I claim:

1. A wet drum counterrotation magnetic separator for separation of magnetically attractable solid particles from a slurry which comprises a tank having a bottom and sidewalls for retention of the slurry, a rotatable drum including a cylindrical wall positioned with a segment of the drum beneath the surface of the slurry, the drum rotating through a circular path having a first lower arc in close proximity to the bottom of the tank, said circular path also having a second lower arc through which the cylindrical wall of the drum rotates, magnet means positioned within the drum and extending around at least the second lower arc of the cylindrical wall of the drum solid particle discharge means at a first side of the tank, slurry inlet means to the first side of the tank for feeding the slurry and solid particles at a relatively high velocity, a low velocity slurry settling zone on a second side of the tank opposite to the first side and in juxtaposition to at least part of the second lower arc, and slurry outlet means from the low velocity settling zone for discharge from the separator of substantially all the slurry which passes through the slurry inlet means, the position of the low velocity settling zone relative to the magnetic means being such that all solid particles in the slurry which are not first attracted to the drum are exposed to magnetic attraction in the low velocity settling zone.

2. The magnetic separator of claim 1 in which magnet means are in juxtaposition to the cylindrical wall of the drum in the low velocity settling zone.

3. The magnetic separator of claim 2 in which the slurry outlet means includes an overflow weir and an underflow outlet.

4. A wet drum counterrotation magnetic separator or separation of magnetically attractive solid particles from a slurry which comprises a slurry tank having side walls and a bottom circular wall, a drum having a cylindrical wall and rotatably mounted such that the drum rotates through a circular path in the tank with a restricted clearance between the cylindrical wall of the drum and the bottom circular wall of the tank, solid particle discharge means at a first side of the tank, slurry injection means at the first side of the tank to pass slurry at a relatively high velocity through the restricted passage between the cylindrical wall of the drum and the bottom circular wall of the tank, a low velocity settling zone on a second side of the tank and opposite to the first side of the tank from the restricted passage, magnet means within the drum and in juxtaposition to the cylindrical wall of the drum in at least the restricted passage and the low velocity settling zone, and slurry outlet means from the low velocity settling zone for discharge from the separator of substantially all the slurry which enters the separator through the slurry injection means, the position of the low velocity settling zone relative to the magnetic means being such that all solid particles in the slurry which are not first attracted to the drum in the restricted passage are exposed to magnetic attraction in the low velocity settling zone.

5. The magnetic separator of claim 4 in which the slurry outlet means includes an overflow weir and an underflow outlet.

* * * * *